United States Patent [19]

Drake

[11] Patent Number: 4,636,102

[45] Date of Patent: Jan. 13, 1987

[54] COMBINATION BRUSH AND APPLICATOR UNIT

[75] Inventor: William J. Drake, Andover, Mass.

[73] Assignee: Ekard Industries, Boston, Mass.

[21] Appl. No.: 541,097

[22] Filed: Oct. 12, 1983

[51] Int. Cl.[4] ..... A46B 11/02

[52] U.S. Cl. ..... 401/190; 222/402.13

[58] Field of Search ..... 401/190; 222/402.13

[56] References Cited

U.S. PATENT DOCUMENTS

| | | | |
|---|---|---|---|
| 2,981,446 | 4/1961 | Campbell | 222/402.13 |
| 3,199,741 | 8/1965 | Lehmann | 222/402.13 |
| 3,370,908 | 2/1968 | Cupp | 401/190 |
| 3,685,913 | 8/1972 | Pass | 401/190 |
| 3,981,597 | 9/1976 | Cohn | 401/190 |
| 4,053,090 | 10/1977 | Kelly et al. | 222/402.13 |
| 4,187,963 | 2/1980 | Mascia | 222/402.13 |

FOREIGN PATENT DOCUMENTS

| | | | |
|---|---|---|---|
| 852410 | 9/1970 | Canada | 401/190 |

*Primary Examiner*—Steven A. Bratlie

*Attorney, Agent, or Firm*—Wolf, Greenfield & Sacks

[57] ABSTRACT

A snap-on cap for an aerosol shaving cream can is disclosed. An integral shaving cream brush is mounted in the cap so that when the cap is snapped onto a can of shaving cream the brush is held at an angle to the can body allowing for more convenient and efficient application of the foam. The cap is assembled in two pieces; a firm outer housing which provides a gripping surface and a flexible activator assembly which allows the cap to be easily snapped onto the aerosol can. The flexible activator assembly is comprised of an activator button rigidly connected to a nozzle by means of a strut. The nozzle and the activator button are each connected by a "hinge" to the brush forming a hinged parallelogram structure which provides sufficient flexibility to prevent activation of the aerosol can when the brush assembly is initially snapped onto the can. The hinged parallelogram allows vertical pressure to operate the can while preventing undesirable side-to-side movement of the activator button.

4 Claims, 6 Drawing Figures

COMBINATION BRUSH AND APPLICATOR UNIT

FIELD OF THE INVENTION

This invention relates to caps for aerosol cans and, in particular, for caps for dispensing aerosol shaving cream.

BACKGROUND OF THE INVENTION

Shaving cream in aerosol cans has been available for many years, however, many people still desire to apply shaving cream with a brush.

Accordingly, many prior art designs have been developed which combine a cap for the aerosol can and with a brush so that the lather is conducted to the brush for application. However, problems with these prior art designs have made them impractical to manufacture or inconvenient to use.

Several of the prior art designs involve the connection of a brush assembly to the cap supplied with the aerosol shaving cream can. These designs have the problem that they were unable to conveniently connect to aerosol caps of different sizes and shapes and thus were suited for use with only a few brands of aerosol shaving cream.

Other prior art brush assemblies were designed to replace the aerosol cap supplied with the aerosol shaving cream can. These assemblies also suffered from several defects. Many prior art assemblies were typically composed of one type of plastic material. If this plastic material is soft and flexible to allow the brush assembly to be easily snapped on the aerosol can, the flexibilty allowed the activator button to move from side-to-side causing erratic operation of the aerosol can. On the other hand, if the brush assembly was composed of a hard plastic material, the aerosol can was often activated prematurely when the assembly was snapped onto the can, causing a waste of shaving cream and a spill which had to be cleaned up. In many cases these prior art assemblies could only be used with certain brands of aerosol shaving cream.

Therefore, it is an object of the present invention to provide a combination brush and activator unit which can be snapped onto an aerosol shaving cream can without causing premature operation of the can.

It is another object of the present invention to provide a combination brush and activator unit which can fit most brands of aerosol shaving cream.

It is yet another object of the present invention to provide a combination brush and activator unit which has flexible surfaces for gripping the aerosol can so that it can endure repeated snap-on and snap-off procedures from the can.

It is still a further object of the present invention to provide a combination brush and applicator unit which has a nozzle with sufficient flexibilty to prevent premature operation of the aerosol can.

It is still a further object of the invention to provide a shaving cream applicator unit which can apply cream from a can with a vertical outlet nozzle into an upwardly angled brush applicator.

It is yet a further object of the invention to provide a shaving cream applicator unit in which the applicator brush is angled upward for more efficient application of shaving foam to the user's face, more efficient transfer of the foam from the can into the applicator brush and more comfortable handling by the user.

It is another object of the invention to provide a shaving cream applicator unit which has an elevated, angled activator button for easy finger access and which does not move side-to-side when pressure is applied.

SUMMARY OF THE INVENTION

The foregoing objects are achieved and the foregoing problems are solved in one illustrative embodiment of the invention in which a combination brush and applicator unit is comprised of two separate pieces; a firm outer housing and a flexible activator assembly.

The outer housing is relatively rigid and supports the applicator brush at an angle to the aerosol can body. The housing also allows for firm gripping of the applicator unit when the unit is being snapped onto and off the aerosol can. The outer housing also prevents cracking of the can mating surfaces through prolonged use.

The activator assembly is relatively flexible and consists of a base portion which snaps over the aerosol can, a nozzle which directs the shaving cream from the can to the angled applicator brush and an activator button which is rigidly connected to the nozzle.

The nozzle and the activator button are each rigidly connected by means of a strut but are each respectively connected to the applicator brush by a hinge. The applicator brush, nozzle, strut and applicator button together form a hinged parallelogram structure which allows vertical pressure on the activator button to be transmitted to the nozzle, in order to activate the aerosol can but prevents side-to-side movement of the nozzle thereby keeping the nozzle centered over the aerosol can outlet. The hinged parallelogram structure has sufficient flexibility so that most aerosol cans can be accommodated without premature operation of the can when the combination brush and applicator assembly is snapped onto the can.

DETAILED DESCRIPTION OF THE PREFERRED EMBODIMENT

Figure 1:
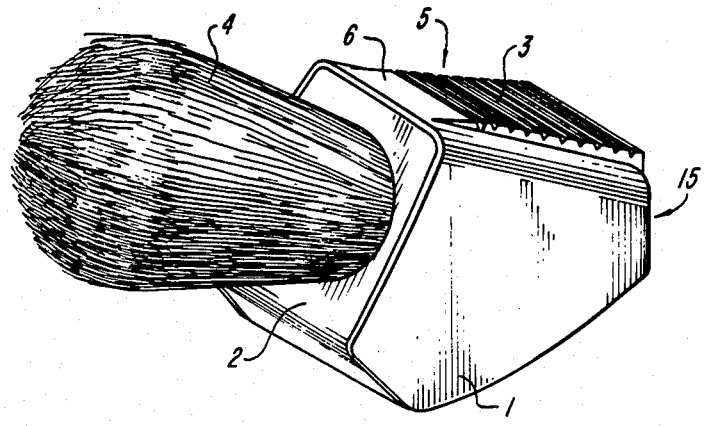
FIG. 1 is a perspective view of the combination brush and applicator unit.

FIG. 1 shows a perspective drawing of the inventive combination brush and applicator unit comprised of an outer housing and an activator assembly. The housing has two side portions, 1 and 5 which are constructed of heavy plastic and allow the unit to be easily gripped for installation and removal on the aerosol can. Side portions 1 and 5 are connected by bridging sections 6 and 15 which, together, form the entire housing unit. The housing supports the activator assembly and allows the applicator brush 4 to be held at an angle which illustratively may be 40° to the horizontal. In addition, as will be explained below, the housing reinforces the base of activator assembly making the structure more durable and able to withstand repeated installation on, and removal from, the aerosol can.

The outer surfaces of the activator assembly are formed from front portion 2 to which the applicator brush 4 is connected and an activator button 3. Also a part of the activator assembly is a base portion and nozzle not shown in the outer view of FIG. 1.

Figure 2:
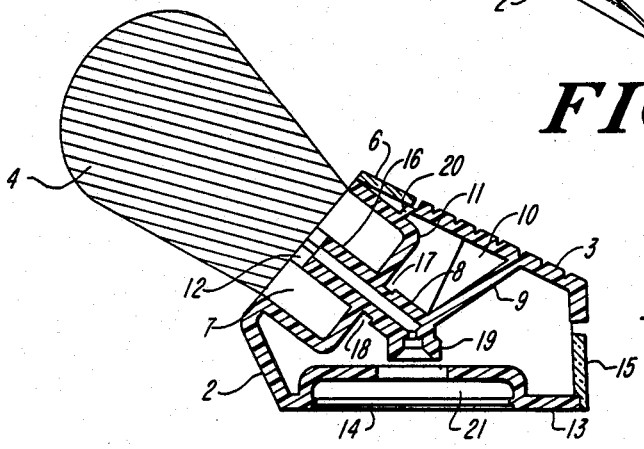
FIG. 2 is a sectional drawing showing the construction of the applicator unit, including the hinges.

FIG. 2 shows a cross-sectional view of the activator assembly. In a portion of front section 2 is a circular well 11 which accepts the brush bristles 4. Bristles 4 are imbedded in a plug 7 which has a circular orifice 12 therethrough for accepting nozzle extension 16 which is an integral portion of the circular well 11. Both well 11 and extension 16 are mounted at an angle to the horizontal in order to support the applicator brush (shown schematically as brush 4).

Extension 16 communicates with nozzle 8 which, in turn, extends towards the interior of the unit at the same angle as extension 16. The interior end of nozzle 8 turns downward and extends vertically for a short distance before it is terminated by a small cap 19 which communicates with the outlet pipe of the aerosol shaving can. Nozzle 8 may have various cross-sectional shapes, however, a circular cross-section is preferred.

In accordance with the invention, nozzle 8 is flexibly attached to the interior wall of well 11. In particular, although nozzle 8 is attached to well 11, a ring-shaped notch is cut in nozzle 8 adjacent to the interior wall of well 11 (partially shown as notches 17 and 18 on the sectional view in FIG. 2) leaving a flexible "hinge" area. The hinge area allows nozzle 8 to move relative to well 11 so that it automatically centers over the shaving cream can outlet pipe when the applicator unit is snapped onto the can.

Part of the activator assembly is activator button 3. Activator button 3 is rigidly connected to nozzle 8 by means of a rigid strut 9 and a rigid brace 10. Strut 9 and brace 10 are generally triangular-shaped pieces which are perpendicularly connected to each other to provide a rigid connection between nozzle 8 and activator button 3 with a cross-section in the form of a "T".

Also, in accordance with the invention, activator button 3 is provided with a hinge 20 which is connected to the interior side of the upper wall of well 11. Hinge 20 and the hinge area of nozzle 8 allow for flexibility of the nozzle and button assembly. In particular, activator button 3, in connection with the upper and rear walls of well 11, nozzle 8 and strut 9 form a parallelogram structure. The parallelogram structure has two rigid joints formed by the connection between button 3 and strut 9 and the connection between strut 9 and nozzle 8. Hinge 20 and the hinge area of nozzle 8 form two flexible joints of the parallelogram structure. This hinged parallelogram structure prevents side-to-side movement (into and out of the plane of the paper) of activator button 3 yet allows the button, strut and nozzle assembly to move in the vertical direction to allow nozzle 8 to center over the aerosol can outlet pipe when the unit is snapped onto the can. The hinged parallelogram structure also allows activator button 3 to be mounted at an angle (illustratively about 40° to the horizontal) to make button 3 easily accessible and convenient to use.

The activator assembly is completed by a base portion 13. Base portion 13 has a circular well 21 containing a small lip 14 which allows the unit to snapped over the aerosol can. Also shown in FIG. 2 are sections of the bridging portions, 6 and 15, of the housing which surrounds the activator unit. The housing sides 1 and 5 mate with two side portions of circular well 21 and reinforce the well sides preventing the well sides from cracking due to repeated installation and removal of the unit from aerosol cans.

Figure 3:
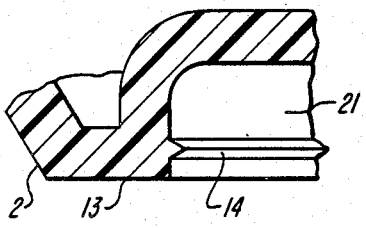
FIG. 3 is a detail of the housing face showing a lip which holds the unit onto the aerosol can.

FIG. 3 of the drawing shows an expanded sectional view of the base portion 13 of the activator assembly showing a portion of well 21 and the lip or ridge 14 which generally has a triangular cross-section and holds the applicator and brush unit onto the lip of the aerosol can.

Figure 4:
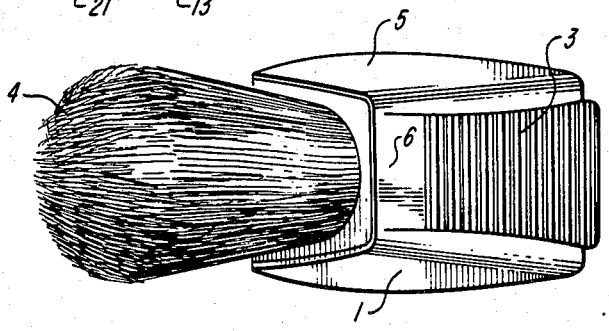
FIG. 4 is a top view of the drawing showing the housing surfaces.

FIG. 4 of the drawing is a top view of the combination applicator and brush unit showing a clearer view of the bridging portion 6 and the housing sides 1 and 5.

Figure 5:
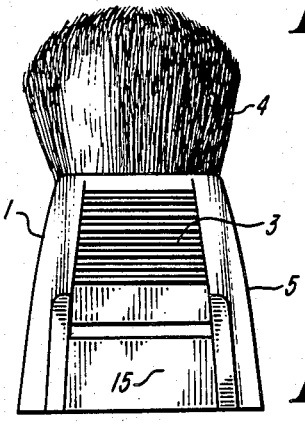
FIG. 5 is a back view of the combination brush and applicator unit showing the rear portion of the housing.

FIG. 5 is a rear view of the applicator and brush unit showing the bridging portion 15 that connects the housing sections 1 and 5.

Figure 6:
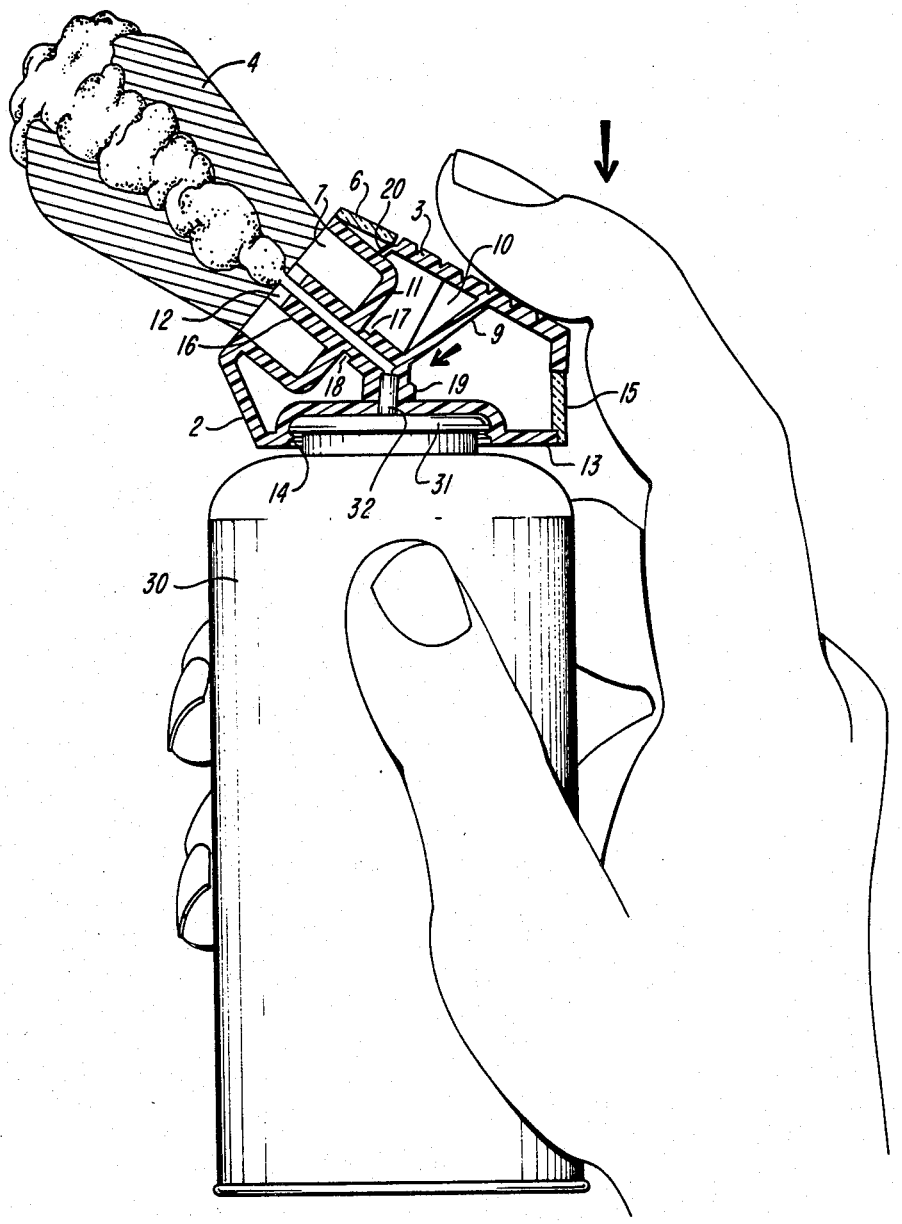
FIG. 6 is a combination perspective and sectional view showing the operation of the combination brush and applicator unit on a can of aerosol shaving cream.

FIG. 6 shows a cross-sectional view of the combination brush and applicator unit snapped onto an aerosol can of shaving cream. In particular, the circular well 21 in the base 13 of the activator assembly mates with a lip 31 on aerosol shaving cream can 30. The applicator and brush assembly is held onto can 30 by means of triangular lip 14 which engages the lower portion of can lip 31. When the combination brush and applicator unit is snapped onto the aerosol can, the cap portion 19 of nozzle 8 engages outlet pipe 32 of the can.

Vertical pressure on the activator button 3 is transmitted by the link member 9 and brace 10 to nozzle 8 causing it to pivot around the hinge area adjacent to well 11 (at notches 17 and 18). Activator button 3 also pivots around hinge 20 which is also connected to well 11. This pivoting action forces pipe 32 in a downward direction, which motion causes the release of shaving cream into nozzle cap 19 and nozzle 8. Nozzle 8, in turn, conveys the cream to bristles 4, via extension 16.

In accordance with the invention, the housing portion of the combination brush and applicator unit is formed of a heavy plastic material which allows the sides of the unit to be firmly gripped when installing or removing the unit from the aerosol can and supports the angled applicator brush. A plastic material suitable for use in the housing is a ABS plastic.

The activator unit, in turn, is formed of a less heavy ABS plastic. The housing and activator unit assembly are fastened together by use of a cement or other procedures suitable for adhering ABS plastic. The brush unit 4, in turn, is fastened or cemented into the wall 11 by means of a suitable adhesive or other means.

What is claimed is:

1. A combination brush and applicator unit for dispensing shaving cream foam from an aerosol can having an outlet pipe displaceable to release said foam and a lip surrounding said pipe for attaching a cap to said can, said unit comprising:

an outer housing comprising
- a pair of substantially planar side members,
- at least one spacer piece for holding said side members a fixed distance apart in a parallel planar relationship, a brush, an activator assembly comprising
- a circular well having a side and a bottom,
- a tubular nozzle extension mounted perpendicularly in the center of the bottom of said well, said extension communicating with said brush, a tubular nozzle for conveying said foam from said pipe to said brush, said nozzle being joined to the bottom of said well on the side opposite from said extension and communicating with said extension, said nozzle having a ring-shaped notch cut therein adjacent to the junction of said nozzle with said well, an activator button wherein said brush and said activator button are at an angle to said pipe, said angle being between 0° and 90°, a rigid strut for mounting said activator button on said nozzle so that pressure applied to said activator button causes said nozzle to move to displace said pipe, and a flexible hinge for attaching said activator button to said side of said well, whereby said activator button, said strut, said nozzle and said side and bottom of said well form a hinged parallelogram structure.

2. A combination brush and applicator unit according to claim 1 wherein said outer housing is comprised of material heavier and more rigid than said the material comprising said activator assembly.

3. A combination brush and applicator unit according to claim 2 wherein said activator assembly further comprises a base having a second circular well therein for engaging said lip.

4. A combination brush and applicator unit according to claim 3 wherein said base is mounted perpendicular to said pipe and said receiving means holds said brush at an acute angle relative to said base.

* * * * *